US011969054B2

(12) United States Patent
Kubis et al.

(10) Patent No.: US 11,969,054 B2
(45) Date of Patent: Apr. 30, 2024

(54) SLIP-RESISTANT FOOTWEAR TREAD INCLUDING WIDE DISPERSION CHANNELS

(71) Applicant: Saf-Gard Safety Shoe Co., Greensboro, NC (US)

(72) Inventors: Patrick Kubis, Greensboro, NC (US); James Randesi, Greensboro, NC (US)

(73) Assignee: Saf-Gard Safety Shoe Co., Greensboro, NC (US)

( * ) Notice: Subject to any disclaimer, the term of this patent is extended or adjusted under 35 U.S.C. 154(b) by 263 days.

(21) Appl. No.: 17/295,948

(22) PCT Filed: Nov. 21, 2019

(86) PCT No.: PCT/US2019/062631
§ 371 (c)(1),
(2) Date: May 21, 2021

(87) PCT Pub. No.: WO2020/106969
PCT Pub. Date: May 28, 2020

(65) Prior Publication Data

US 2022/0000217 A1 Jan. 6, 2022

Related U.S. Application Data

(60) Provisional application No. 62/770,248, filed on Nov. 21, 2018.

(51) Int. Cl.
*A43B 13/22* (2006.01)
*A43B 13/12* (2006.01)

(52) U.S. Cl.
CPC ..... *A43B 13/223* (2013.01); *A43B 13/122* (2013.01)

(58) Field of Classification Search
CPC ..... A43B 13/223; A43B 13/122
See application file for complete search history.

(56) References Cited

U.S. PATENT DOCUMENTS

| | | | | |
|---|---|---|---|---|
| 4,375,728 | A | 3/1983 | Dassler | |
| 6,860,037 | B1 * | 3/2005 | Norek | A43B 13/223 D2/908 |
| D611,691 | S * | 3/2010 | Lubart | D2/947 |
| D661,477 | S | 6/2012 | Kubis et al. | |
| 8,322,050 | B2 * | 12/2012 | Lubart | A43B 13/223 D2/960 |
| 8,365,441 | B2 * | 2/2013 | Kirby | A43C 15/00 36/59 C |
| D773,165 | S * | 12/2016 | Youn | D2/962 |
| D818,253 | S * | 5/2018 | Liu | D2/951 |
| D841,961 | S * | 3/2019 | Chow | D2/951 |
| D841,962 | S * | 3/2019 | Chow | D2/951 |
| D852,482 | S * | 7/2019 | Tao | D2/951 |
| 11,246,376 | B2 * | 2/2022 | Lubart | A43B 5/08 |

(Continued)

*Primary Examiner* — Bao-Thieu L Nguyen
(74) *Attorney, Agent, or Firm* — E. Eric Mills; Carlo Julio Salas; Maynard Nexsen PC

(57) ABSTRACT

A slip-resistant footwear tread including wide dispersion channels is disclosed. Namely, a slip-resistant footwear tread is provided that is formed of any arrangement of repeating tread patterns that may include wide dispersion channels amongst an arrangement of tread elements and/or features, wherein the wide dispersion channels are of suitable width and depth to reduce, or substantially eliminate, the accumulation, sticking, and/or gumming of materials therein.

20 Claims, 9 Drawing Sheets

(56) References Cited

U.S. PATENT DOCUMENTS

| | | | | |
|---|---|---|---|---|
| 2002/0078598 | A1* | 6/2002 | Bell | A43B 13/223 36/102 |
| 2011/0017373 | A1* | 1/2011 | Lee | A43B 13/223 152/209.18 |
| 2011/0247237 | A1* | 10/2011 | Jara | A43B 13/223 36/103 |
| 2012/0110876 | A1* | 5/2012 | Lubart | A43B 13/223 36/59 C |
| 2014/0026438 | A1* | 1/2014 | Cortez | A43B 13/188 36/28 |
| 2016/0302523 | A1* | 10/2016 | Fujita | A43B 13/122 |
| 2016/0304155 | A1* | 10/2016 | Klein | B62M 3/086 |
| 2020/0060386 | A1* | 2/2020 | Lubart | A43B 13/22 |
| 2020/0170335 | A1* | 6/2020 | Horvath | A43B 13/28 |
| 2020/0315293 | A1* | 10/2020 | Zhao | A43B 3/0052 |

* cited by examiner

SLIP-RESISTANT FOOTWEAR TREAD INCLUDING WIDE DISPERSION CHANNELS

CROSS REFERENCE TO RELATED APPLICATIONS

This application is a 35 U.S.C. § 371 U.S. national phase entry of International Application No. PCT/US2019/062631 having an international filing date of Nov. 21, 2019, which claims priority under 35 U.S.C. § 119 to U.S. Provisional Application No. 62/770,248 filed Nov. 21, 2018, and the entirety of each is incorporated by reference herein.

TECHNICAL FIELD

The presently disclosed subject matter relates generally to footwear and more particularly to a slip-resistant footwear tread including wide dispersion channels.

BACKGROUND

In footwear, the outsole, also known as the sole, is the bottommost part of a shoe that comes in direct contact with the ground. The outsole can be made out of a variety of materials, including leather and rubber. Certain types of outsoles provide more traction than others by using specific materials or tread designs. It all depends on the style and intended purpose of the shoe. For example, a ballroom dancer might prefer a shoe with a smooth leather sole that makes it easier to glide and turn on the dance floor, while a hiker needs a shoe with a thick, durable and waterproof outsole that has tread suitable for hiking. Most shoes have soles made out of natural rubber, polyurethane or poly vinyl chloride (PVC) compounds. Shoes are designed with durable outsoles to be as long-lasting as possible, but these will wear out over time.

In certain applications, there may be concern of the footwear tread clogging and losing its slip-resistant properties. For example, in a bakery application, certain tread designs may be prone to the sticking or gumming of flour or similar materials in the channels of the tread.

SUMMARY

The following presents a simplified summary of the invention in order to provide a basic understanding of some aspects of the invention. This summary is not an extensive overview of the invention. It is not intended to identify key or critical elements of the invention or to delineate the scope of the invention; its sole purpose is to present concepts of the invention in a simplified form as a prelude to the more detailed description that is subsequently presented.

In one embodiment of the present invention, a slip-resistant footwear outsole is provided that may be formed by an outsole material having a tread pattern formed by an arrangement of tread elements. The tread pattern may include repeating tread patterns of the tread elements, the tread elements within the repeating tread patterns may be separated from each other by one or more narrow dispersion channels having a width and a depth, and the repeating tread patterns may be separated from each other by one or more wide dispersion channels having a width and a depth.

In one embodiment the tread elements may include one or more substantially square tread elements. In another embodiment, the tread elements may include one or more substantially square tread elements and one or more substantially rectangular tread elements.

In yet another embodiment, the one or more substantially square tread elements may be about 4 mm square, and the one or more substantially rectangular tread elements may a width of about 4 mm wide and a length of about 8.5 mm.

The tread elements may also include one or more substantially square tread elements and one or more substantially L-shaped tread elements. In this embodiment, the one or more substantially square tread elements may be about 4 mm square, and the narrow portions of the one or more substantially L-shaped tread elements may have a width of about 4 mm wide, and the wide portions of the one or more substantially L-shaped tread elements may have a width of about 8.5 mm.

In another embodiment, the width of the one or more narrow dispersion channels may be about 0.5 mm and the depth of the one or more narrow dispersion channels may be about 1.25 mm. In still another embodiment, the width of the one or more wide dispersion channels may be from about 4 mm to about 5.5 mm, and the depth of the one or more wide dispersion channels may be about 3 mm.

In still another embodiment, the repeating tread patterns of the tread pattern may include a plurality micro-patterns of the tread elements. The plurality of micro-patterns may be separated from each other by the one or more wide dispersion channels. Further, each micro-pattern of the plurality of micro-patterns may be different from one another.

In one embodiment, each micro-pattern of the plurality of micro-patterns may include one or more square tread elements and one or more L-shaped tread elements separated by the one or more narrow dispersion channels. In still another embodiment, each micro-pattern of the plurality of micro-patterns may include one or more square tread elements and one or more rectangular tread elements separated by the one or more narrow dispersion channels.

The plurality of micro-patterns may further include one or more micro-patterns of one or more square tread elements and one or more rectangular tread elements separated by the one or more narrow dispersion channels, and one or more micro-patterns of one or more square tread elements and one or more L-shaped tread elements separated by the one or more narrow dispersion channels.

In still another embodiment, the repeating tread patterns may include four repeating tread patterns in a 2×2 arrangement.

The present invention may include one or more narrow dispersion channels that may be a groove formed in the outsole material, wherein each narrow dispersion channel protrudes inward from a walk surface. Further, the one or more wide dispersion channels may be a groove formed in the outsole material protruding inward from the walk surface, wherein each of the one or more wide dispersion channel may have a channel ceiling, a channel opening at the walk surface, and angled sidewalls leading from the channel opening to the channel ceiling. In one embodiment, the channel ceiling may be narrower than the channel opening. In another embodiment, the inside edges of channel ceilings of each of the one or more wide dispersion channels may be radiused.

In another embodiment, each of the one or more wide dispersion channels may have a depth of about 3 mm, the channel opening may have a width of about 4 mm, the channel ceiling may have a width of about 1.2 mm, and the angled sidewalls may have an angle of about 25 degrees.

The present invention further describes a shoe or boot that may have an upper portion and a slip-resistant footwear outsole having a material with a tread pattern that may be formed by an arrangement of tread elements. The tread pattern may include repeating tread patterns of the tread elements, the tread elements within the repeating tread patterns may be separated from each other by one or more narrow dispersion channels having a width and a depth, and the repeating tread patterns may be separated from each other by one or more wide dispersion channels having a width and a depth.

The width of the one or more narrow dispersion channels may be about 0.5 mm and the depth of the one or more narrow dispersion channels is about 1.25 mm. Further, the width of the one or more wide dispersion channels may be from about 4 mm to about 5.5 mm, and the depth of the one or more wide dispersion channels may be about 3 mm.

Other features will be apparent to those skilled in the arts, techniques and equipment relevant to the present invention from a careful review of the Drawings and a reading of the Detailed Description.

BRIEF DESCRIPTION OF DRAWINGS

Figure 1A:
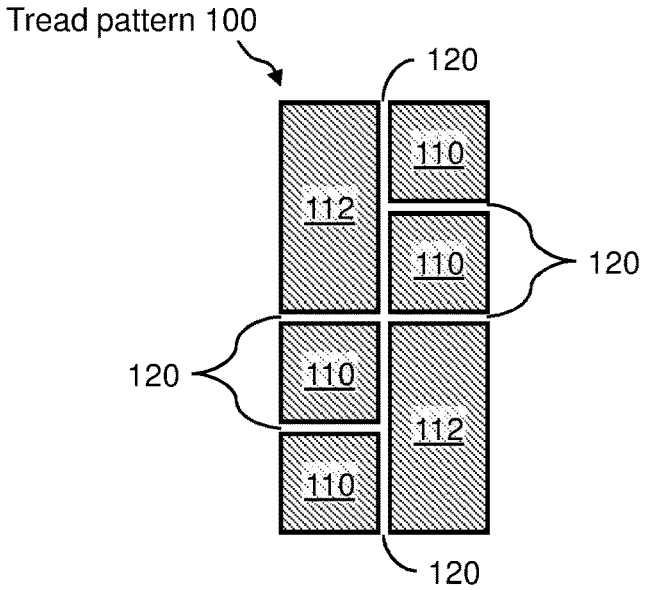
Figure 1B:
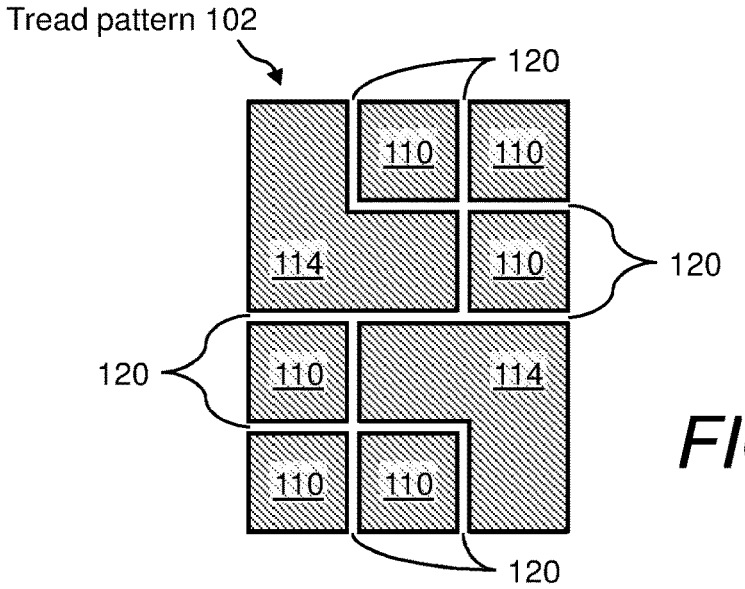
Figure 1C:
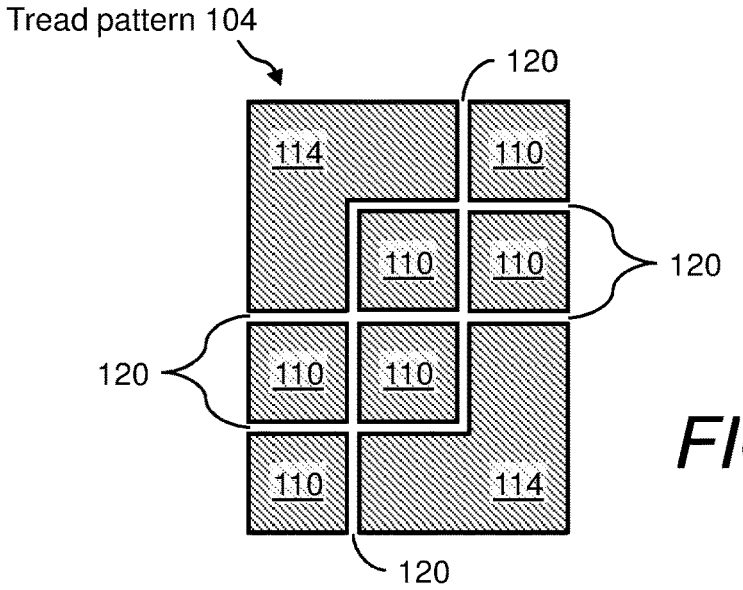
Figure 2:
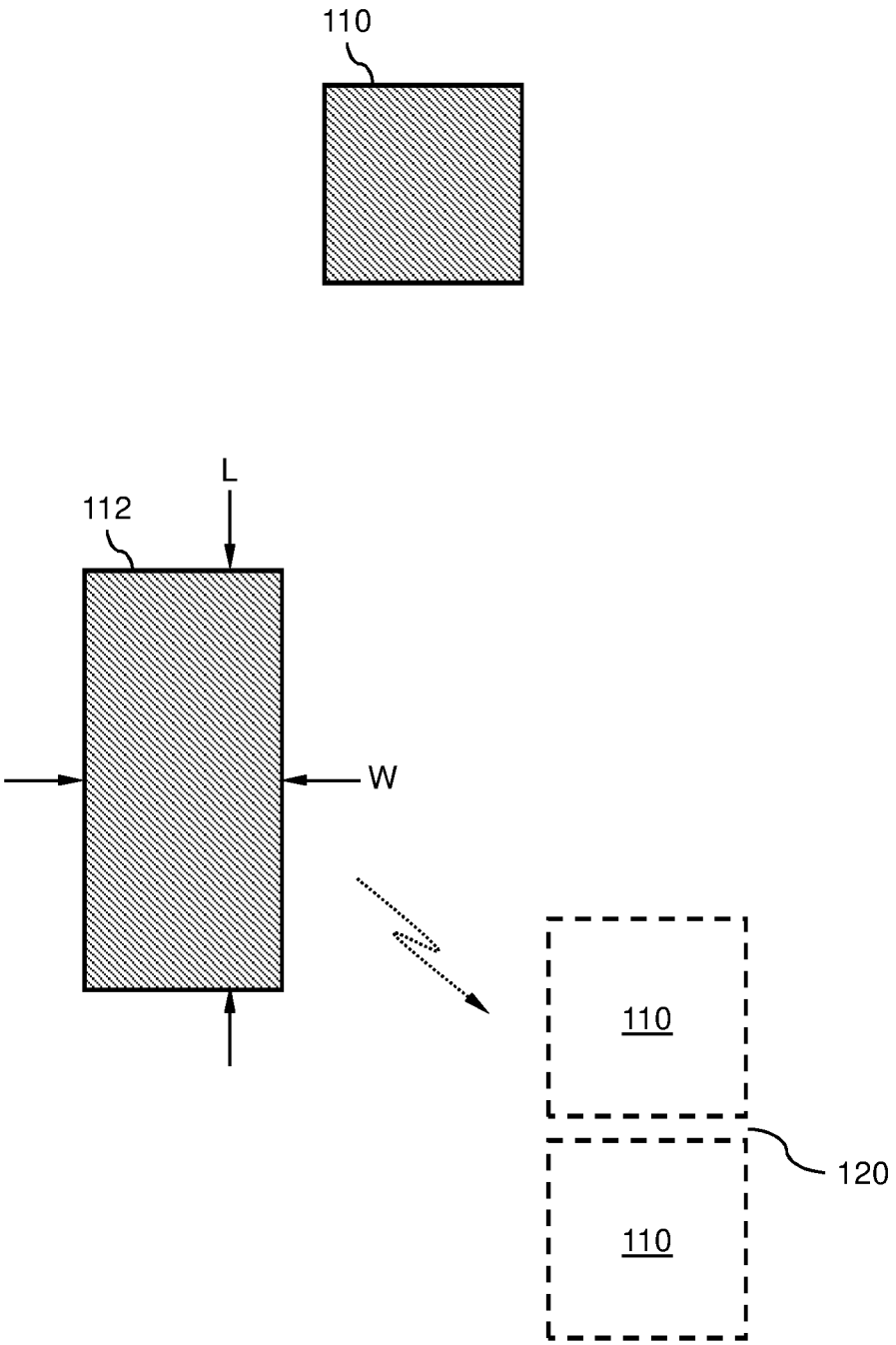
Figure 3:
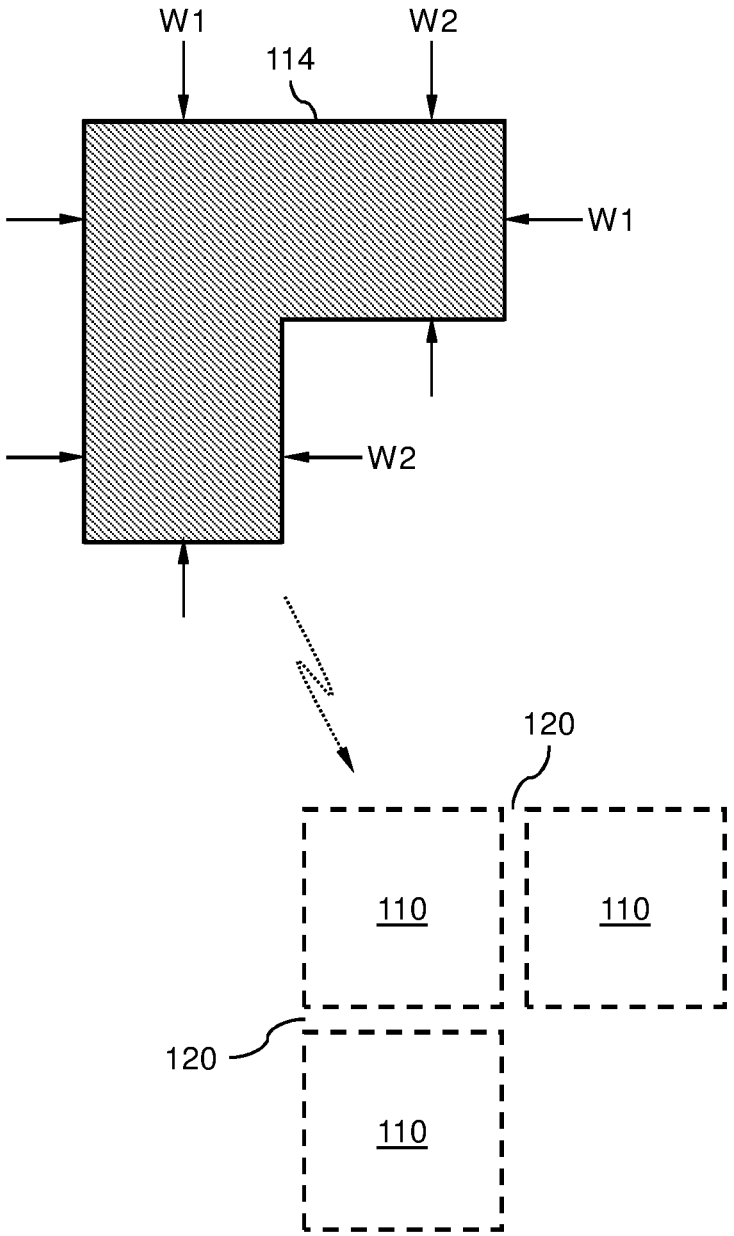
Figure 4:
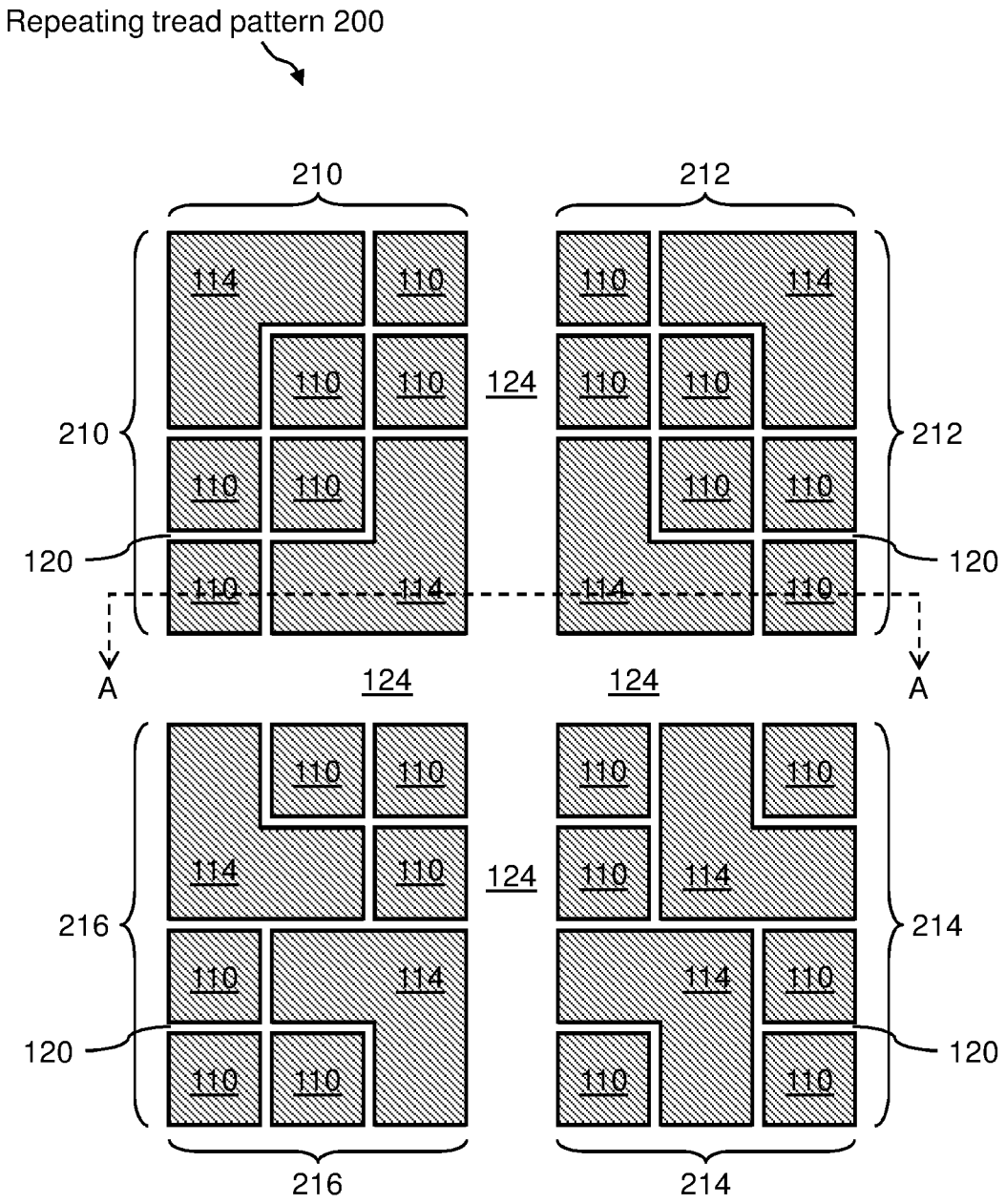
Figure 5:
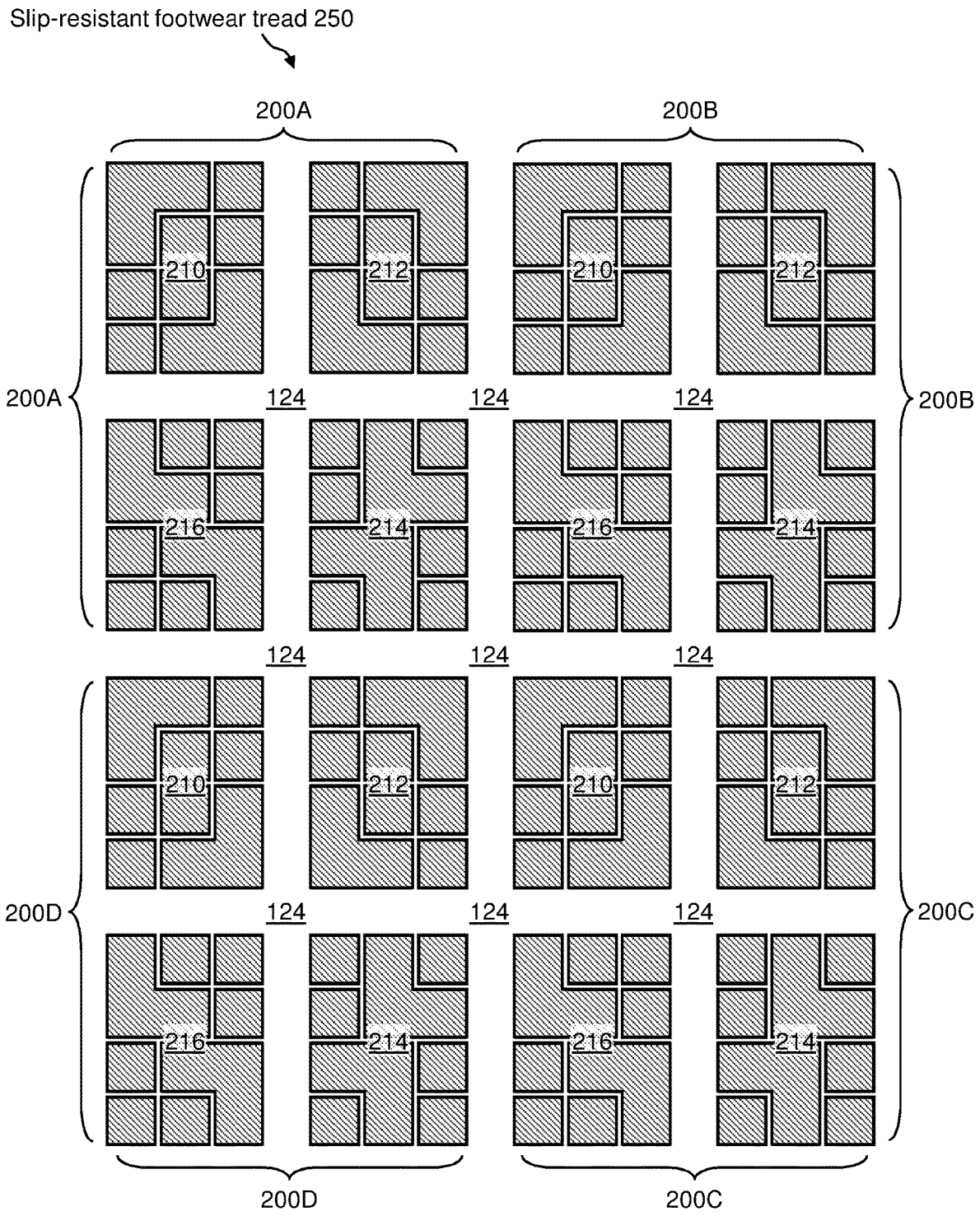
Figure 6:
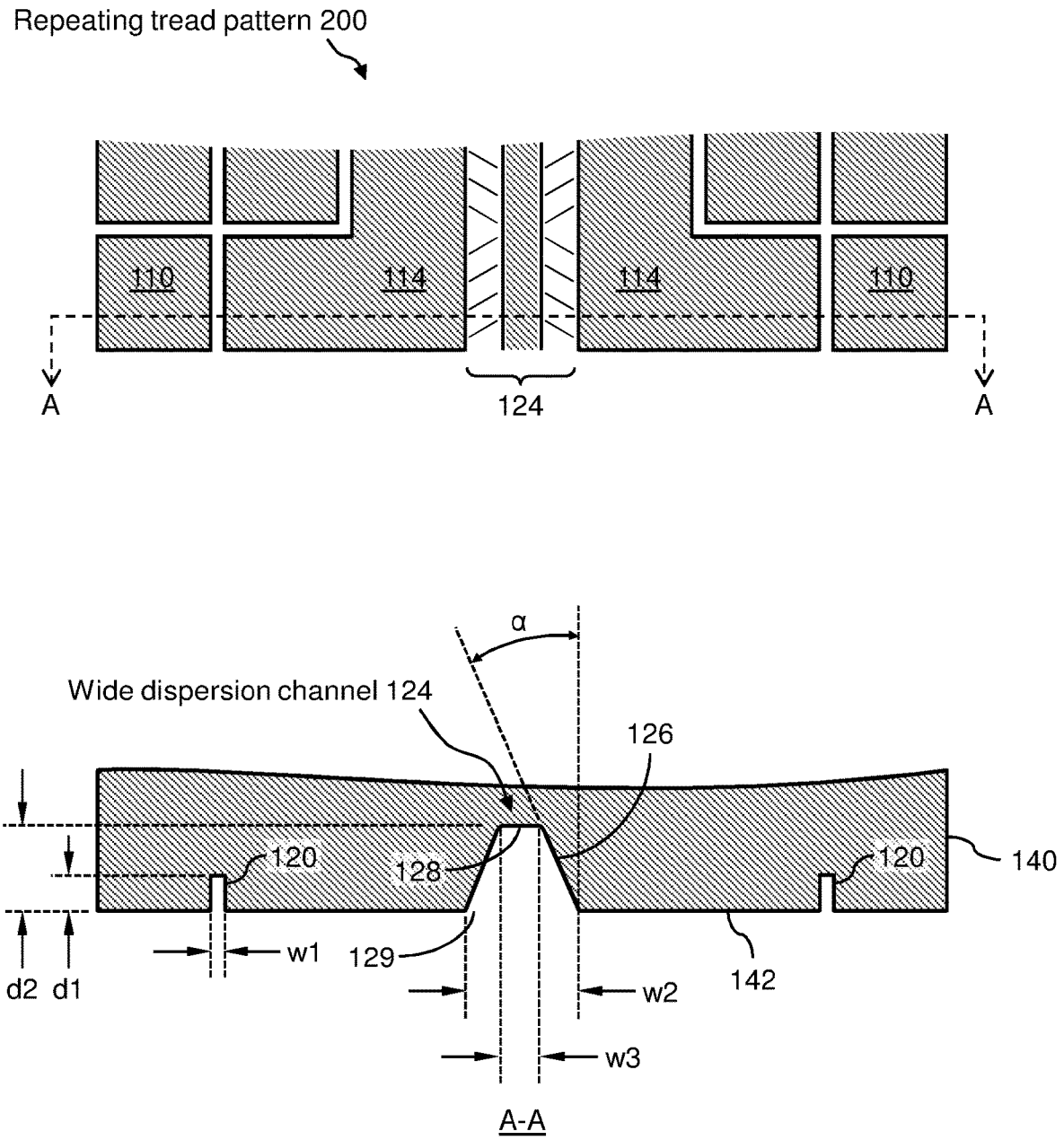
Figure 7:
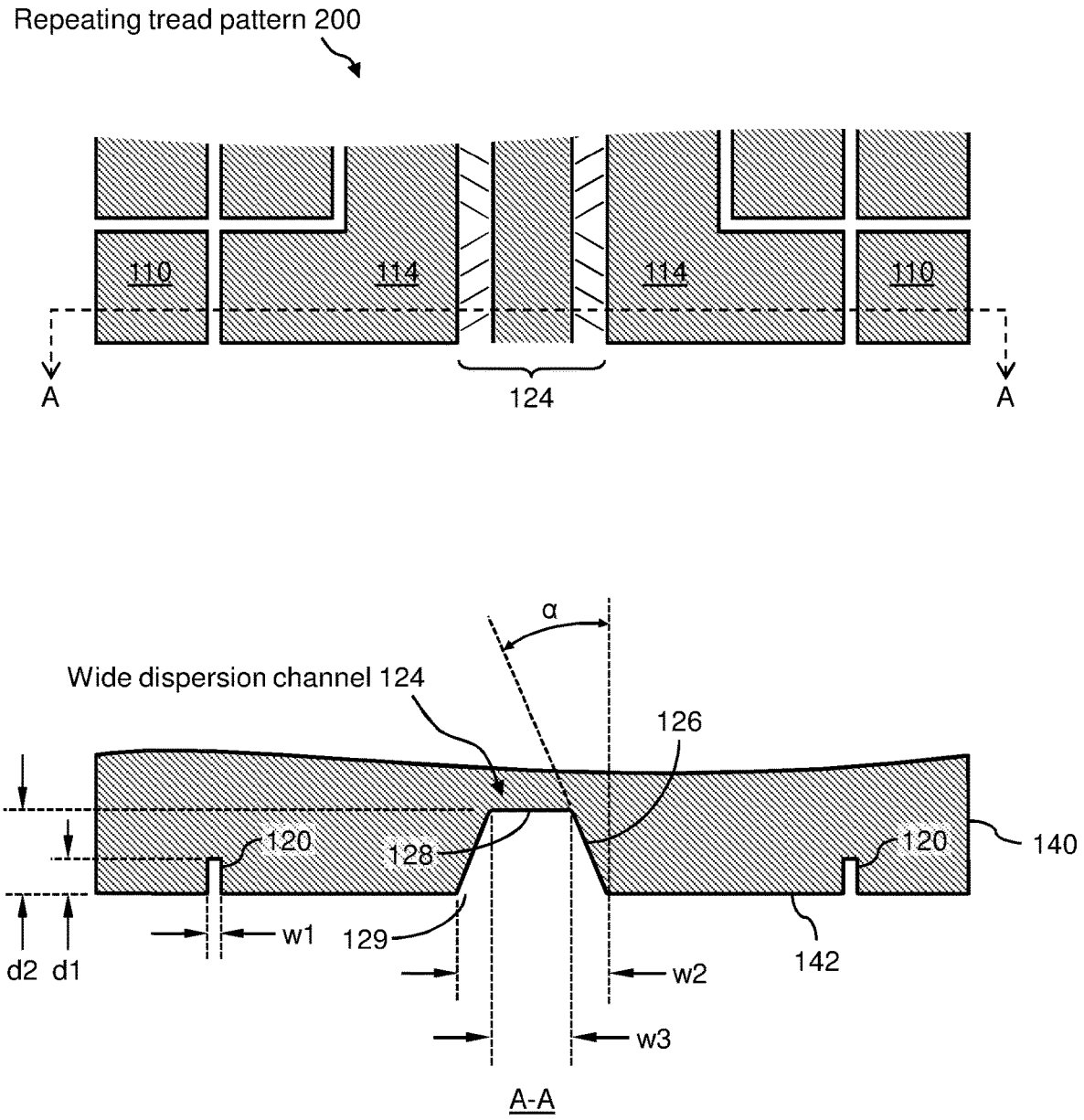
Figure 8:
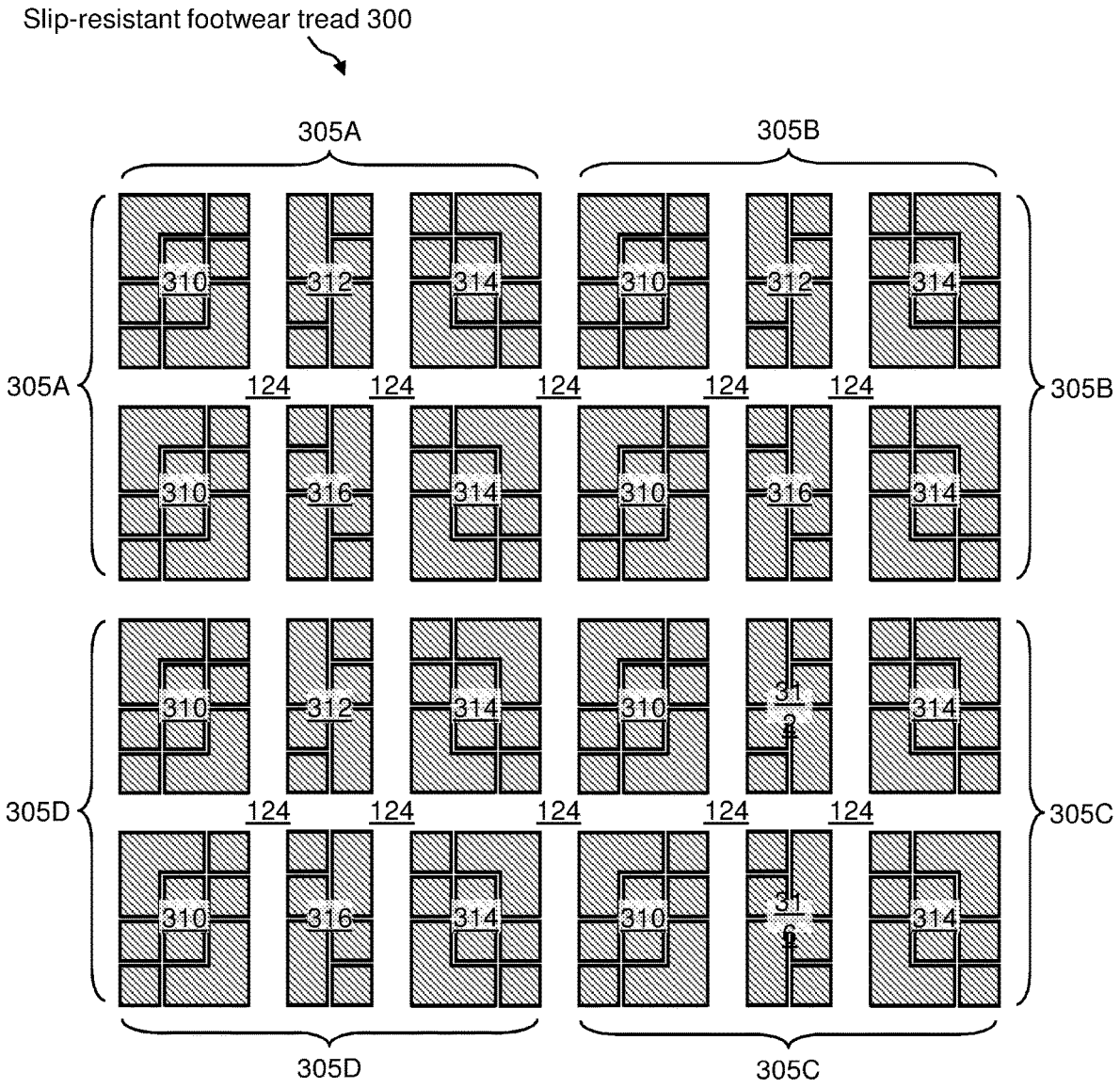
Figure 9:
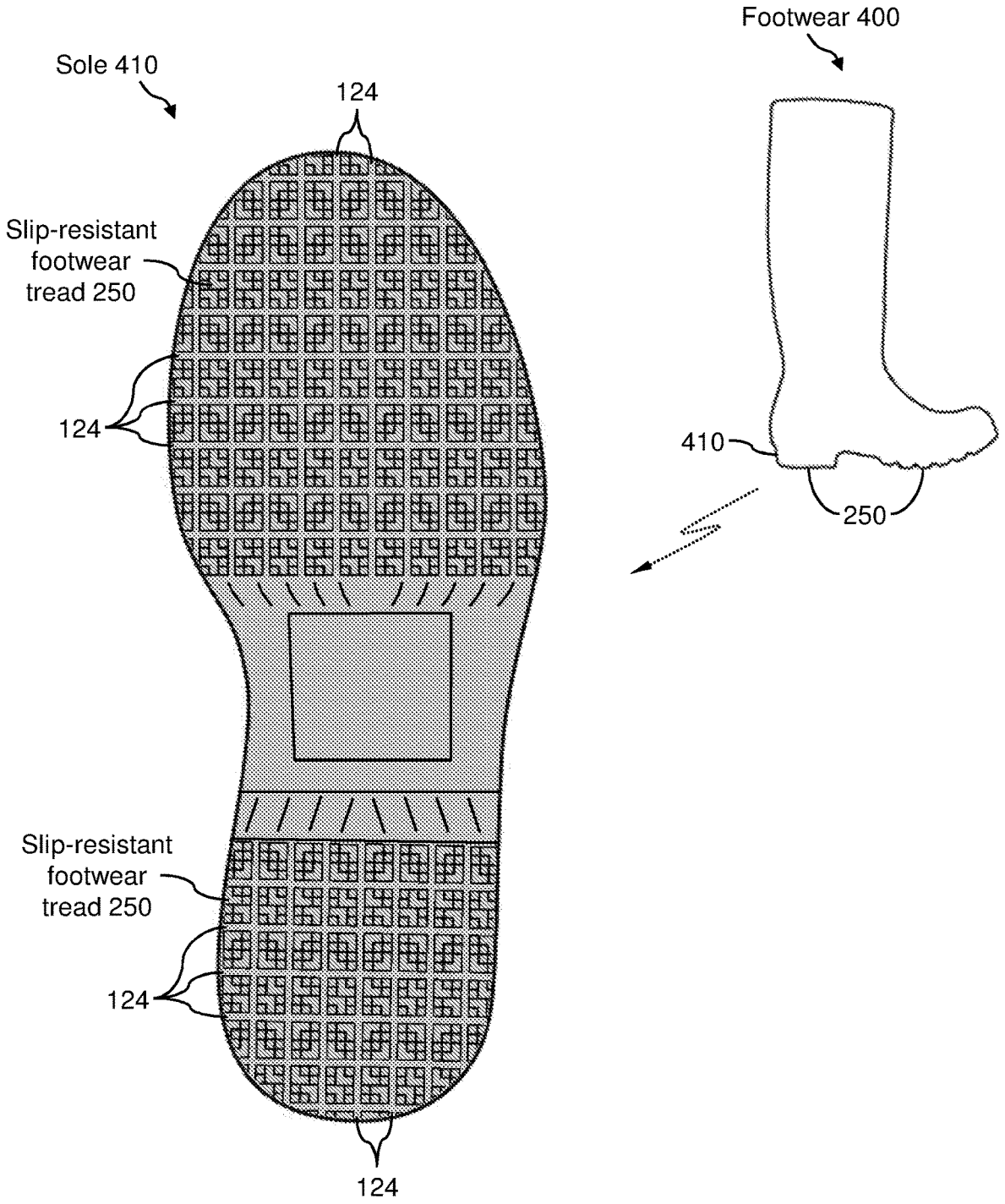

Having thus described the presently disclosed subject matter in general terms, reference will now be made to the accompanying Drawings, which are not necessarily drawn to scale, and wherein:

FIG. 1A, FIG. 1B, and FIG. 1C illustrate plan views of examples of tread patterns of the presently disclosed slip-resistant footwear tread including wide dispersion channels;

FIG. 2 illustrates plan views of an example of a square tread element and a rectangular tread element for forming the tread patterns of the presently disclosed slip-resistant footwear tread including wide dispersion channels;

FIG. 3 illustrates a plan view of an example of an L-shaped tread element for forming the tread patterns of the presently disclosed slip-resistant footwear tread including wide dispersion channels;

FIG. 4 illustrates a plan view of an example of a repeating tread pattern of the presently disclosed slip-resistant footwear tread, wherein the repeating tread pattern includes wide dispersion channels;

FIG. 5 illustrates a plan view of an example of the presently disclosed slip-resistant footwear tread formed of an arrangement of multiple repeating tread patterns shown in FIG. 4 and wherein the slip-resistant footwear tread includes the wide dispersion channels;

FIG. 6 illustrates a plan view and a cross-sectional view of the repeating tread pattern shown in FIG. 4 and showing more details of an example of narrow dispersion channels and wide dispersion channel of the presently disclosed slip-resistant footwear tread;

FIG. 7 illustrates a plan view and a cross-sectional view of the repeating tread pattern shown in FIG. 4 and showing more details of another example of narrow dispersion channels and wide dispersion channel of the presently disclosed slip-resistant footwear tread;

FIG. 8 illustrates a plan view of another example of the presently disclosed slip-resistant footwear tread formed of an arrangement of multiple repeating tread patterns and wherein the slip-resistant footwear tread includes wide dispersion channels; and FIG. 9 illustrates a plan view of an example of the sole of a boot or shoe that includes the presently disclosed slip-resistant footwear tread including wide dispersion channels.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a slip-resistant footwear sole with a tread including wide dispersion channels among tread elements. The pattern of the presently disclosed slip-resistant footwear tread may include wide dispersion channels that are of suitable width and depth to reduce, or substantially eliminate, the accumulation, sticking, and/or gumming of materials in the channels. In one example, in a bakery application, the presence of the wide dispersion channels in the footwear tread design can reduce, or substantially eliminate, the accumulation, sticking, and/or gumming of flour or similar materials in the channels.

In some embodiments, the presently disclosed slip-resistant footwear tread may include repeating tread patterns of tread elements that are separated by wide dispersion channels and wherein the repeating tread patterns may be formed of any arrangement of tread elements and/or features separated by one or more narrow dispersion channels. Examples of tread elements and/or features may include, but are not limited to, substantially square tread elements, substantially rectangular tread elements, substantially L-shaped tread elements, and the like.

In some embodiments, the presently disclosed slip-resistant footwear tread including wide dispersion channels may be provided on the soles of any type of footwear, such as, but not limited to, any type of athletic shoes (e.g., sneakers, running shoes, hiking shoes), any type of boots (e.g., rubber boots, work boots, mud boots, snow boots), any type of casual footwear (e.g., sandals, canvas shoes), and the like.

Referring now to FIG. 1A, FIG. 1B, and FIG. 1C are plan views of examples of tread patterns of the presently disclosed slip-resistant footwear tread including wide dispersion channels. FIG. 1A shows an example of a tread pattern 100 that may include an arrangement of substantially square tread elements 110 and substantially rectangular tread elements 112. FIG. 1B shows an example of a tread pattern 102 that may include an arrangement of substantially square tread elements 110 and substantially L-shaped tread elements 114. FIG. 1C shows an example of a tread pattern 104 that may include another arrangement of substantially square tread elements 110 and substantially L-shaped tread elements 114.

In tread patterns 100, 102, and 104, the square tread elements 110, rectangular tread elements 112, and/or L-shaped tread elements 114 may be separated by one or more narrow dispersion channels 120. In one example, each of the narrow dispersion channels 120 has a width of about 0.5 mm and a depth of about 1.25 mm.

Referring now to FIG. 2 is plan views of an example of a square tread element 110 and a rectangular tread element 112 for forming the tread patterns (e.g., tread patterns 100, 102, and 104) of the presently disclosed slip-resistant footwear tread including wide dispersion channels. Further, FIG. 3 is a plan view of an example of an L-shaped tread element 114. In one example, square tread elements 110 may be about 4 mm square. In like manner, rectangular tread element 112 may be sized based on the 4 mm square tread elements 110. For example, the footprint of rectangular tread element 112 may be about equivalent to two square tread elements 110 separated by a narrow dispersion channel 120 (see FIG. 2). Accordingly, if a narrow dispersion channel 120 is about 0.5 mm wide, then rectangular tread element 112 may have a width W of about 4 mm and a length L of about 8.5 mm.

Similarly, L-shaped tread elements 114 may be sized based on the 4 mm square tread elements 110. For example, FIG. 3 shows the footprint of L-shaped tread elements 114 may be about equivalent to three square tread elements 110 arranged in an L configuration and separated by narrow dispersion channels 120. Accordingly, if each narrow dispersion channel 120 is about 0.5 mm wide, then the wide portions of L-shaped tread elements 114 may have a width W1 of about 8.5 mm. Further, the narrow portions of L-shaped tread elements 114 may have a width W2 of about 4 mm.

While any tread patterns described hereinabove and hereinbelow may be based on square tread elements 110 that may be about 4 mm square, this is exemplary only. The presently disclosed slip-resistant footwear tread is not limited to being based on 4 mm square tread elements 110. The presently disclosed slip-resistant footwear tread may be based on any size tread elements (e.g., any size square tread elements 110, rectangular tread elements 112, and L-shaped tread elements 114).

Referring now to FIG. 4 is a plan view of an example of a repeating tread pattern 200 that can form the presently disclosed slip-resistant footwear tread (see FIG. 5). Repeating tread pattern 200 may include a plurality of micro-patterns. For example, the repeating tread pattern 200 may include four micro-patterns that are different from one another. In this example, repeating tread pattern 200 may include a micro-pattern 210, a micro-pattern 212, a micro-pattern 214, and a micro-pattern 216. Each of the micro-patterns 210, 212, 214, and 216 may include a certain arrangement of square tread elements 110 and L-shaped tread elements 114 separated by narrow dispersion channels 120.

Micro-patterns 210, 212, 214, and 216 are different from one another. For example, micro-pattern 210 may include one arrangement of square tread elements 110 and L-shaped tread elements 114. Micro-pattern 212 may include a different arrangement of square tread elements 110 and L-shaped tread elements 114. Micro-pattern 214 may include yet a different arrangement of square tread elements 110 and L-shaped tread elements 114. Micro-pattern 216 may include still a different arrangement of square tread elements 110 and L-shaped tread elements 114.

In each of the micro-patterns 210, 212, 214, and 216, the various square tread elements 110 and/or L-shaped tread elements 114 are separated by narrow dispersion channels 120. Further, in repeating tread pattern 200, the micro-patterns 210, 212, 214, and 216 themselves are separated by wide dispersion channels 124. In one example, wide dispersion channels 124 may have a width of about 4 mm and a depth of about 3 mm, as shown in FIG. 6. In another example, wide dispersion channels 124 may have a width of about 5.5 mm and a depth of about 3 mm, as shown in FIG. 7.

Referring now to FIG. 5 is a plan view of an example of the presently disclosed slip-resistant footwear tread 250 formed of an arrangement of multiple repeating tread patterns 200 (see FIG. 4) and wherein slip-resistant footwear tread 250 may include wide dispersion channels 124. In this example, slip-resistant footwear tread 250 may include four instances of repeating tread pattern 200 (e.g., repeating tread patterns 200A, 200B, 200C, 200D) in a 2×2 arrangement. However, this arrangement is exemplary only. Slip-resistant footwear tread 250 may include any number and arrangement of repeating tread patterns 200.

In slip-resistant footwear tread 250, wide dispersion channels 124 are included in each of repeating tread patterns 200A, 200B, 200C, 200D. Further, the repeating tread patterns 200A, 200B, 200C, 200D themselves are separated by wide dispersion channels 124.

Referring now to FIG. 6 is a plan view of a portion of repeating tread pattern 200 and a cross-sectional view taken along line A-A this portion of repeating tread pattern 200 as well as shown in FIG. 4. In these views, more details of narrow dispersion channels 120 and wide dispersion channel 124 of the presently disclosed slip-resistant footwear tread 250 are shown. In this example, outsole material 140 is provided, wherein one side of outsole material 140 provides a walk surface 142.

Each of the narrow dispersion channels 120 is a groove that is formed in outsole material 140, wherein each narrow dispersion channel 120 protrudes inward from walk surface 142. In one example, narrow dispersion channel 120 may have a width w1 of about 0.5 mm and a depth d1 of about 1.25 mm.

Wide dispersion channel 124 is a groove that is formed in outsole material 140, wherein wide dispersion channel 124 protrudes inward from walk surface 142. Wide dispersion channel 124 may have angled sidewalls 126 leading to a channel ceiling 128, which is narrower than a channel opening 129 of wide dispersion channel 124 at walk surface 142. Further, the inside edges of wide dispersion channel 124 (at channel ceiling 128) may be radiused.

In this example, channel opening 129 of wide dispersion channel 124 may have a width w2 of about 4 mm, channel ceiling 128 of wide dispersion channel 124 may have a width w3 of about 1.2 mm, and wide dispersion channel 124 may have a depth d2 of about 3 mm. Further, angled sidewalls 126 may be set at an angle $\alpha$. The angle $\alpha$ calculated from the aforementioned dimensions may be about 25 degrees. This is one example of a wide dispersion channel 124 that has suitable width and depth to reduce, or substantially eliminate, the accumulation, sticking, and/or gumming of materials therein.

In another example and referring now to FIG. 7, channel opening 129 of wide dispersion channel 124 may have a width w2 of about 5.5 mm, channel ceiling 128 of wide dispersion channel 124 may have a width w3 of about 2.7 mm, and wide dispersion channel 124 may have a depth d2 of about 3 mm. Further, angled sidewalls 126 may be set at an angle $\alpha$. The angle $\alpha$ calculated from the aforementioned dimensions may be about 25 degrees. This is another example of a wide dispersion channel 124 that has suitable width and depth to reduce, or substantially eliminate, the accumulation, sticking, and/or gumming of materials therein. It is additionally contemplated that there could be some variation in the width of the wide dispersion channel 124. For instance, wide dispersion channel 124 may have a width w2 of about 6.0 mm, and channel ceiling 128 of wide dispersion channel 124 may have a width w3 of about 3.2 mm, all with the wide dispersion channel 124 depth d2 remaining at about 3 mm.

Referring now to FIG. 8 is a plan view of another example of the presently disclosed slip-resistant footwear tread 300 formed of an arrangement of multiple repeating tread patterns 305 and wherein slip-resistant footwear tread 300 may include wide dispersion channels 124. In this example, slip-resistant footwear tread 300 may include four instances of repeating tread pattern 305 (e.g., repeating tread patterns 305A, 305B, 305C, 305D) in a 2×2 arrangement. However, this arrangement is exemplary only. Slip-resistant footwear tread 250 may include any number and arrangement of repeating tread patterns 305.

Repeating tread pattern 305 may include, for example, four micro-patterns that are different from one another. In this example, repeating tread pattern 305 may include two instances of a micro-pattern 310, a micro-pattern 312, two instances of a micro-pattern 314, and a micro-pattern 316. Each of the micro-patterns 310 and 314 may include a certain arrangement of square tread elements 110 and L-shaped tread elements 114 separated by narrow dispersion channels 120. Each of the micro-patterns 312 and 316 may include a certain arrangement of square tread elements 110 and rectangular tread elements 112 separated by narrow dispersion channels 120. Micro-patterns 310, 312, 314, and 316 are different from one another. For example, micro-patterns 310 and 314 may include different arrangements of square tread elements 110 and L-shaped tread elements 114. Micro-patterns 312 and 316 may include different arrangements of square tread elements 110 and rectangular tread elements 112.

In slip-resistant footwear tread 300, wide dispersion channels 124 are included in each of repeating tread patterns 305A, 305B, 305C, 305D. Further, the repeating tread patterns 305A, 305B, 305C, 305D themselves are separated by wide dispersion channels 124.

Referring now to FIG. 9 is a plan view of an example of the sole of a boot or shoe that includes the presently disclosed slip-resistant footwear tread including wide dispersion channels. For example, the footwear 400 includes an upper boot or shoe portion a sole 410. The sole 410 of footwear 400 may be patterned with the slip-resistant footwear tread 250 shown in FIG. 5 and wherein slip-resistant footwear tread 250 may include wide dispersion channels 124. The sole 410 of footwear 400 that includes slip-resistant footwear tread 250 may be formed, for example, of natural rubber, polyurethane, and/or PVC compounds.

Referring now again to FIG. 1 through FIG. 9, the presently disclosed the presently disclosed slip-resistant footwear tread (e.g., slip-resistant footwear tread 250, 300) includes wide dispersion channels 124 that are of suitable width and depth to reduce, or substantially eliminate, the accumulation, sticking, and/or gumming of materials therein. Accordingly, the slip-resistant properties of the presently disclosed slip-resistant footwear tread 250, 300 can be maintained.

Further, the presently disclosed slip-resistant footwear tread (e.g., slip-resistant footwear tread 250, 300) may include repeating tread patterns (e.g., repeating tread patterns 200, 305) that are separated by wide dispersion channels 124 and that may themselves include wide dispersion channels 124. The repeating tread patterns (e.g., repeating tread patterns 200, 305) may be formed of any arrangement of tread elements and/or features (e.g., square tread elements 110, rectangular tread elements 112, and L-shaped tread elements 114) separated by one or more narrow dispersion channels 120.

Further, the presently disclosed slip-resistant footwear tread (e.g., slip-resistant footwear tread 250, 300) including wide dispersion channels 124 may be provided on the soles of any type of footwear (e.g., sole 410 of footwear 400 shown in FIG. 9), such as, but not limited to, any type of athletic shoes (e.g., sneakers, running shoes, hiking shoes), any type of boots (e.g., rubber boots, work boots, mud boots, snow boots), any type of casual footwear (e.g., sandals, canvas shoes), and the like.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the invention.

That which is claimed:

1. A shoe or boot comprising:

an upper portion; and a slip-resistant footwear outsole formed by a material having a tread pattern of an arrangement of tread elements, wherein the tread pattern includes repeating tread patterns of the tread elements, wherein each of the repeating tread patterns include six substantially square tread elements and two substantially L-shaped tread elements comprising a narrow portion, wherein the tread elements within the repeating tread patterns are separated from each other by one or more narrow dispersion channels having a width and a depth, wherein each of the one or more narrow dispersion channels is a groove that is formed in the outsole material, wherein each of the one or more narrow dispersion channels protrudes inward from a walk surface, wherein the repeating tread patterns are separated from each other by one or more wide dispersion channels having angled side walls having an angle α of about 25 degrees, wherein each of the one or more wide dispersion channels is a groove formed in the outsole material protruding inward from the walk surface, wherein each of the one or more wide dispersion channels has a channel ceiling and a channel opening at the walk surface, wherein the angled sidewalls of the wide dispersion channels lead from the channel opening to the channel ceiling, wherein each of the one or more wide dispersion channels has a wide dispersion channel opening width of about 4.0 mm and a wide dispersion channel ceiling width of about 1.2 mm, and wherein each of the one or more wide dispersion channels has a depth of about 3 mm.

2. The shoe or boot of claim 1, wherein each of the repeating tread patterns include one or more substantially rectangular tread elements.

3. The shoe or boot of claim 2, wherein each of the one or more substantially square tread elements is about 4 mm square, and wherein each of the one or more substantially rectangular tread elements has a width of about 4 mm wide and a length of about 8.5 mm.

4. The shoe or boot of claim 2, wherein each of the one or more substantially square tread elements is about 4 mm square, and wherein the narrow portions of the one or more substantially L-shaped tread elements have a width of about 4 mm wide and the wide portions of the one or more substantially L-shaped tread elements have a width of about 8.5 mm.

5. The shoe or boot of claim 1, wherein the width of the one or more narrow dispersion channels is about 0.5 mm and the depth of the one or more narrow dispersion channels is about 1.25 mm.

6. The shoe or boot of claim 1, wherein the repeating tread patterns include a plurality of micro-patterns of the tread elements, and wherein the plurality of micro-patterns are separated from each other by the one or more wide dispersion channels.

7. The shoe or boot of claim 6, wherein each micro-pattern of the plurality of micro-patterns includes one or more square tread elements and one or more L-shaped tread elements separated by the one or more narrow dispersion channels.

8. The shoe or boot of claim 6, wherein each micro-pattern of the plurality of micro-patterns includes one or more square tread elements and one or more rectangular tread elements separated by the one or more narrow dispersion channels.

9. The shoe or boot of claim 6, wherein the plurality of micro-patterns includes one or more micro-patterns of one or more square tread elements and one or more rectangular tread elements separated by the one or more narrow dispersion channels, and one or more micro-patterns of one or more square tread elements and one or more L-shaped tread elements separated by the one or more narrow dispersion channels.

10. The shoe or boot of claim 6, wherein the repeating tread patterns include four repeating tread patterns in a 2×2 arrangement.

11. The shoe or boot of claim 1, wherein the channel ceiling of the wide dispersion channels are narrower than the channel opening of the wide dispersion channels.

12. A shoe or boot comprising:

an upper portion; and a slip-resistant footwear outsole formed by a material having a tread pattern of an arrangement of tread elements, wherein the tread pattern includes repeating tread patterns of the tread elements, wherein each of the repeating tread patterns include six substantially square tread elements and two substantially L-shaped tread elements comprising a narrow portion, wherein the tread elements within the repeating tread patterns are separated from each other by one or more narrow dispersion channels having a width and a depth, wherein each of the one or more narrow dispersion channels is a groove that is formed in the outsole material, wherein each of the one or more narrow dispersion channels protrudes inward from a walk surface, wherein the repeating tread patterns are separated from each other by one or more wide dispersion channels having angled side walls having an angle α of about 25 degrees, wherein each of the one or more wide dispersion channels is a groove formed in the outsole material protruding inward from the walk surface, wherein each of the one or more wide dispersion channels has a channel ceiling and a channel opening at the walk surface, wherein the angled sidewalls of the wide dispersion channels lead from the channel opening to the channel ceiling, wherein each of the one or more wide dispersion channels has a wide dispersion channel opening width of about 5.5 mm and a wide dispersion channel ceiling width of about 2.7 mm, and wherein each of the one or more wide dispersion channels has a depth of about 3 mm.

13. The shoe or boot of claim 12, wherein the width of the one or more narrow dispersion channels is about 0.5 mm and the depth of the one or more narrow dispersion channels is about 1.25 mm.

14. The shoe or boot of claim 12, wherein each of the repeating tread patterns include one or more substantially rectangular tread elements, wherein each of the one or more substantially square tread elements is about 4 mm square, wherein each of the one or more substantially rectangular tread elements has a width of about 4 mm wide and a length of about 8.5 mm, and wherein the narrow portions of the one or more substantially L-shaped tread elements have a width of about 4 mm wide and the wide portions of the one or more substantially L-shaped tread elements have a width of about 8.5 mm.

15. The shoe or boot of claim 12, wherein the repeating tread patterns include a plurality of micro-patterns of the tread elements, wherein the plurality of micro-patterns are separated from each other by the one or more wide dispersion channels, wherein each micro-pattern of the plurality of micro-patterns includes one or more square tread elements and one or more rectangular tread elements separated by the one or more narrow dispersion channels, and one or more square tread elements and one or more L-shaped tread elements separated by the one or more narrow dispersion channels.

16. The shoe or boot of claim 12, wherein the channel ceiling of the wide dispersion channels are narrower than the channel opening of the wide dispersion channels.

17. A shoe or boot comprising:

an upper portion; and a slip-resistant footwear outsole formed by a material having a tread pattern of an arrangement of tread elements, wherein the tread pattern includes repeating tread patterns of the tread elements, wherein each of the repeating tread patterns include six substantially square tread elements and two substantially L-shaped tread elements comprising a narrow portion, wherein the tread elements within the repeating tread patterns are separated from each other by one or more narrow dispersion channels having a width and a depth, wherein each of the one or more narrow dispersion channels is a groove that is formed in the outsole material, wherein each of the one or more narrow dispersion channels protrudes inward from a walk surface, wherein the repeating tread patterns are separated from each other by one or more wide dispersion channels having angled side walls having an angle $\alpha$ of about 25 degrees, wherein each of the one or more wide dispersion channels is a groove formed in the outsole material protruding inward from the walk surface, wherein each of the one or more wide dispersion channels has a channel ceiling and a channel opening at the walk surface, wherein the angled side-walls of the wide dispersion channels lead from the channel opening to the channel ceiling,-wherein each of the one or more wide dispersion channels has a wide dispersion channel opening width of about 5.5 mm and a wide dispersion channel ceiling width of about 2.7 mm, and wherein each of the one or more wide dispersion channels has a depth of about 3 mm.

18. The shoe or boot of claim 17, wherein each of the repeating tread patterns include one or more substantially rectangular tread elements, wherein each of the one or more substantially square tread elements is about 4 mm square, wherein each of the one or more substantially rectangular tread elements has a width of about 4 mm wide and a length of about 8.5 mm, and wherein the narrow portions of the one or more substantially L-shaped tread elements have a width of about 4 mm wide and the wide portions of the one or more substantially L-shaped tread elements have a width of about 8.5 mm.

19. The shoe or boot of claim 17, wherein the repeating tread patterns include a plurality of micro-patterns of the tread elements, wherein the plurality of micro-patterns are separated from each other by the one or more wide dispersion channels, wherein each micro-pattern of the plurality of micro-patterns includes one or more square tread elements and one or more rectangular tread elements separated by the one or more narrow dispersion channels, and one or more square tread elements and one or more L-shaped tread elements separated by the one or more narrow dispersion channels.

20. The shoe or boot of claim 17, wherein the channel ceiling of the wide dispersion channels are narrower than the channel opening of the wide dispersion channels.

* * * * *